US010179670B2

(12) United States Patent
Lun et al.

(10) Patent No.: US 10,179,670 B2
(45) Date of Patent: Jan. 15, 2019

(54) PACKAGING ASSEMBLY COMPRISING A FOLDING FLAP AND FASTENERS

(71) Applicant: E-pac Packaging Services Co. Ltd., Shatin, N.T., Hong Kong (CN)

(72) Inventors: Tin Yeu Terence Lun, Hong Kong (CN); Zhong Zhu Luo, DongGuan (CN); Xiao Hu Zhou, DongGuan (CN)

(73) Assignee: E-PAC PACKAGING SERVICES CO. LTD., Shek Mun, Shatin, N.T., Hong Kong (CN)

( * ) Notice: Subject to any disclaimer, the term of this patent is extended or adjusted under 35 U.S.C. 154(b) by 0 days.

(21) Appl. No.: 15/441,264

(22) Filed: Feb. 24, 2017

(65) Prior Publication Data

US 2018/0244427 A1 Aug. 30, 2018

(51) Int. Cl.
*B65D 5/50* (2006.01)

(52) U.S. Cl.
CPC ..... *B65D 5/5028* (2013.01)

(58) Field of Classification Search
CPC ..... B65D 5/32; B65D 5/48; B65D 5/48024; B65D 5/50; B65D 5/5028; B65D 5/5088; B65D 5/56; B65D 7/06; B65D 7/16; B65D 11/186; B65D 25/108; B65D 71/06; B65D 81/02; B65D 81/05; B65D 81/07; B65D 81/075
USPC ..... 206/583
See application file for complete search history.

(56) References Cited

U.S. PATENT DOCUMENTS 3,905,474 A 9/1975 Haibara
4,852,743 A 8/1989 Ridgeway
4,923,065 A 5/1990 Ridgeway
5,071,009 A 12/1991 Ridgeway
5,388,701 A 2/1995 Ridgeway
5,678,695 A 10/1997 Ridgeway et al.
6,010,006 A * 1/2000 Ridgeway ..... B65D 5/5028 206/583

(Continued)

FOREIGN PATENT DOCUMENTS

CN 201999267 U 10/2011
JP 2014108785 A * 6/2014 ..... B65D 81/07
JP 8033060 A * 11/2016 ..... B65D 81/05

OTHER PUBLICATIONS

Eng. translation, Eng. translation of the abstract of CN201999267.

*Primary Examiner* — Bryon Gehman
(74) *Attorney, Agent, or Firm* — Squire Patton Boggs (US) LLP

(57) ABSTRACT

Provided herein is, among other things, a packaging assembly comprising a substantially rigid panel comprising a folding flap; a film material and mating releasable fastener members, wherein the rigid panel comprises a pair of long edges, a pair of short edges, a base, a middle portion between the base and the folding flap, a first fold line between the middle portion and the base, a second fold line between the middle portion and the folding flap, and optionally a pair of folding side portions each connected to the opposite long edges of the base with a pair of third fold lines between the pair of folding side portions and the base, and wherein an object to be packaged is held securely between the film material and the rigid panel. Also provided herein are methods of packaging an object using the packaging assembly disclosed herein.

19 Claims, 9 Drawing Sheets

(56) References Cited

U.S. PATENT DOCUMENTS

| | | | | |
|---|---|---|---|---|
| 6,073,761 | A * | 6/2000 | Jones | B65D 5/5028 206/583 |
| 6,148,590 | A | 11/2000 | Ridgeway et al. | |
| 6,148,591 | A | 11/2000 | Ridgeway et al. | |
| 6,289,655 | B1 | 9/2001 | Ridgeway et al. | |
| 6,311,844 | B1 | 11/2001 | Ridgeway et al. | |
| 8,783,459 | B1 * | 7/2014 | Marcinkowski | B65D 5/5088 206/583 |
| 9,309,024 | B2 | 4/2016 | Hammerschmidt et al. | |
| 9,828,160 | B2 * | 11/2017 | Ridgeway | B65D 81/075 |
| 9,868,578 | B2 * | 1/2018 | Ridgeway | B65D 81/05 |
| 2015/0314936 | A1 | 11/2015 | Stack, Jr. | |

* cited by examiner

PACKAGING ASSEMBLY COMPRISING A FOLDING FLAP AND FASTENERS

FIELD OF THE INVENTION

Provided herein is a packaging assembly comprising a substantially rigid panel, a film material, a folding flap and mating releasable fastener members, wherein an object to be packaged is held securely between the film material and the rigid panel. Also provided herein are methods of packaging an object using the packaging assembly disclosed herein.

BACKGROUND OF THE INVENTION

Packaging assemblies have long been used to secure an object to be packaged which requires protection from physical shock, dust, dirt and other contaminants. For example, when shipping objects which is comparatively fragile or sensitive, it is often desirable to secure the object inside a box to protect the object from physical shocks, dust, dirt and other contaminants which may occur during loading, transit and unloading.

Many packaging assemblies include a rigid panel, a flexible film material and additional structures to keep an object and the packaging assembly within a box from moving uncontrollably in the box. Such additional structures generally include a pair of folding side flaps and a pair of folding end flaps around a center portion of the rigid panel. An object is inserted between the flexible film material and the center portion and is secured when the folding side flaps are folded away from the flexible film material to tighten the flexible film material against the object. The folding end flaps are then folded in the same or opposite direction to the folding side flaps. The rigid panel in its folded condition is then placed in a box having interior dimensions which correspond to the peripheral dimensions of the folded rigid panel. The major problem with this type of packaging assembly is that it is difficult to keep the packaging assembly in the folded condition by one assembler. It is because while the pair of folding side flaps are folded in order to tighten the flexible film material against the object, the tension created on the flexible film material means that the pair of folding side flaps would rebound to an unfolded condition. Thus, the flexible film material would remain relaxed over the object unless an assembler continuously holds onto the pair of folding side flaps with both hands. With both hands being occupied, the assembler could not fold the pair of folding end flaps without the assistance of an additional assembler. Without fixing both pairs of folding side flaps and folding end flaps to their respective folded positions, the rigid panel could not be smoothly fitted into a box having interior dimensions which correspond to the peripheral dimensions of the folded rigid panel.

Therefore, there is a need for a packaging assembly that can successfully secure objects against a substantially rigid panel and prevent uncontrolled movement of the objects when the rigid panel and the objects are packaged within a box. There is also a need for a packaging assembly that can be easily operated and fitted into a box by a single assembler.

SUMMARY OF THE INVENTION

Provided herein is a packaging assembly that can successfully secure an object against a substantially rigid panel and prevent uncontrolled movement of the objects when the rigid panel and the object is packaged within a box. Also provided herein is a packaging assembly that can be easily operated and fitted into a box by a single assembler.

In one aspect, provided herein is a packaging assembly comprising:

a) a substantially rigid panel;

b) a film material; and c) a pair of mating releasable fastener members, wherein the rigid panel comprises a pair of long edges, a pair of short edges, a base, a folding flap, a middle portion between the base and the folding flap, a first fold line between the middle portion and the base, and a second fold line between the middle portion and the folding flap, wherein the film material superimposed on a first surface of the rigid panel comprises a pair of opposite ends, wherein the pair of opposite ends are connected to the rigid panel adjacent to the opposite short edges, and wherein one of the pair of mating releasable fastener members is attached to a second surface of the rigid panel opposite to the first surface, and adjacent to the opposite short edges.

In some embodiments, the first fold line and the second fold line are substantially transverse to the pair of long edges, the pair of long edges, the first fold line and the second fold line define the middle portion, the pair of long edges, one of the short edges and the first fold line define the base, and the pair of long edges, one of the short edges and the second fold line define the folding flap.

In certain embodiments, the rigid panel further comprises a pair of folding side portions, wherein the pair of folding side portions are connected to the opposite long edges of the base, wherein a pair of third fold lines are between the pair of folding side portions and the base.

In some embodiments, the mating releasable fastener members comprise one or more pairs of mating releasable fastener members.

In certain embodiments, the mating releasable fastener members comprise hook-and-loop fasteners, mating magnetic fasteners, self-mating pressure sensitive adhesive fasteners, or a combination thereof.

In some embodiments, the mating releasable fastener members are hook-and-loop fasteners.

In certain embodiments, the first fold line between the middle portion and the base is a cut line and the middle portion and the base remain attached to each other.

In some embodiments, the pair of opposite ends of the film material are connected to the rigid panel by sewing, adhering, gluing, heat welding, ultrasonic welding, stapling, tacking, fastening, clipping, anchoring, retaining and/or securing.

In certain embodiments, the packaging assembly further comprises at least an opening each in the base and in the middle portion respectively and adjacent to a long edge.

In some embodiments, the packaging assembly further comprises at least a cutout each in the base and in the middle portion respectively and along a long edge.

In certain embodiments, the rigid panel has an unfolded condition in which the base, the folding flap and the middle portion are substantially coplanar and has a folded condition in which the folding flap and the middle portion are folded away from the film material and are substantially parallel to the base.

In some embodiments, the rigid panel has an unfolded condition in which the base, the folding flap, the middle portion and the pair of folding side portions are substantially coplanar and has a folded condition in which the folding flap and the middle portion are folded away from the film material and are substantially parallel to the base, and the pair of folding side portions are folded towards the film material and are substantially transverse to the base.

In certain embodiments, the packaging assembly further comprises a box adapted to receive the rigid panel in the folded condition, the box having interior dimensions corresponding to the peripheral dimensions of the rigid panel when folded so that the rigid panel is securely held within the box.

In another aspect, provided herein is a method for packaging an object in the packaging assembly disclosed herein, wherein the method comprises the steps of:

a) folding the middle portion away from the film material and towards the second surface of the rigid panel;

b) folding the folding flap towards the film material and away from the second surface of the rigid panel;

c) inserting at least a portion of the object into the packaging assembly through an opening defined by an unsecured edge portion of the film material and the rigid panel on the first surface of the rigid panel;

d) folding the folding flap away from the film material and towards the second surface of the rigid panel until the folding flap is secured on the second surface of the rigid panel by the mating releasable fastener members, in which the film material is tightened against at least a portion of the object; and e) placing the folded panel with the object into a box having interior dimensions corresponding to the peripheral dimensions of the folded panel.

In another aspect, provided herein is a method for packaging an object in the packaging assembly disclosed herein, wherein the method comprises the steps of:

a) folding the middle portion towards the film material;

b) inserting at least a portion of the object into the packaging assembly through an opening defined by an unsecured edge portion of the film material and the rigid panel on the first surface of the rigid panel;

c) folding the middle portion and the folding flap away from the film material and towards the second surface of the rigid panel until the middle portion is substantially parallel to the base and the folding flap is secured on the second surface of the rigid panel by the mating releasable fastener members, in which the film material is tightened against at least a portion of the object; and d) placing the folded panel with the object into a box having interior dimensions corresponding to the peripheral dimensions of the folded panel.

In another aspect, provided herein is a method for packaging an object in the packaging assembly disclosed herein, wherein the method comprises the steps of:

a) folding the middle portion away from the film material and towards the second surface of the rigid panel;

b) folding the folding flap towards the film material and away from the second surface of the rigid panel;

c) inserting at least a portion of the object into the packaging assembly through an opening defined by an unsecured edge portion of the film material and the rigid panel on the first surface of the rigid panel;

d) folding the folding flap away from the film material and towards the second surface of the rigid panel until the folding flap is secured on the second surface of the rigid panel by the mating releasable fastener members, in which the film material is tightened against at least a portion of the object and the pair of folding side portions are folded towards the film material and are substantially transverse to the base; and e) placing the folded panel with the object into a box having interior dimensions corresponding to the peripheral dimensions of the folded panel.

In another aspect, provided herein is a method for packaging an object in the packaging assembly disclosed herein, wherein the method comprises the steps of:

a) folding the middle portion towards the film material;

b) inserting at least a portion of the object into the packaging assembly through an opening defined by an unsecured edge portion of the film material and the rigid panel on the first surface of the rigid panel;

c) folding the middle portion and the folding flap away from the film material and towards the second surface of the rigid panel until the middle portion is substantially parallel to the base and the folding flap is secured on the second surface of the rigid panel by the mating releasable fastener members, in which the film material is tightened against at least a portion of the object and the pair of folding side portions are folded towards the film material and are substantially transverse to the base; and d) placing the folded panel with the object into a box having interior dimensions corresponding to the peripheral dimensions of the folded panel.

DETAILED DESCRIPTION OF THE INVENTION

Definitions

Figure 1:
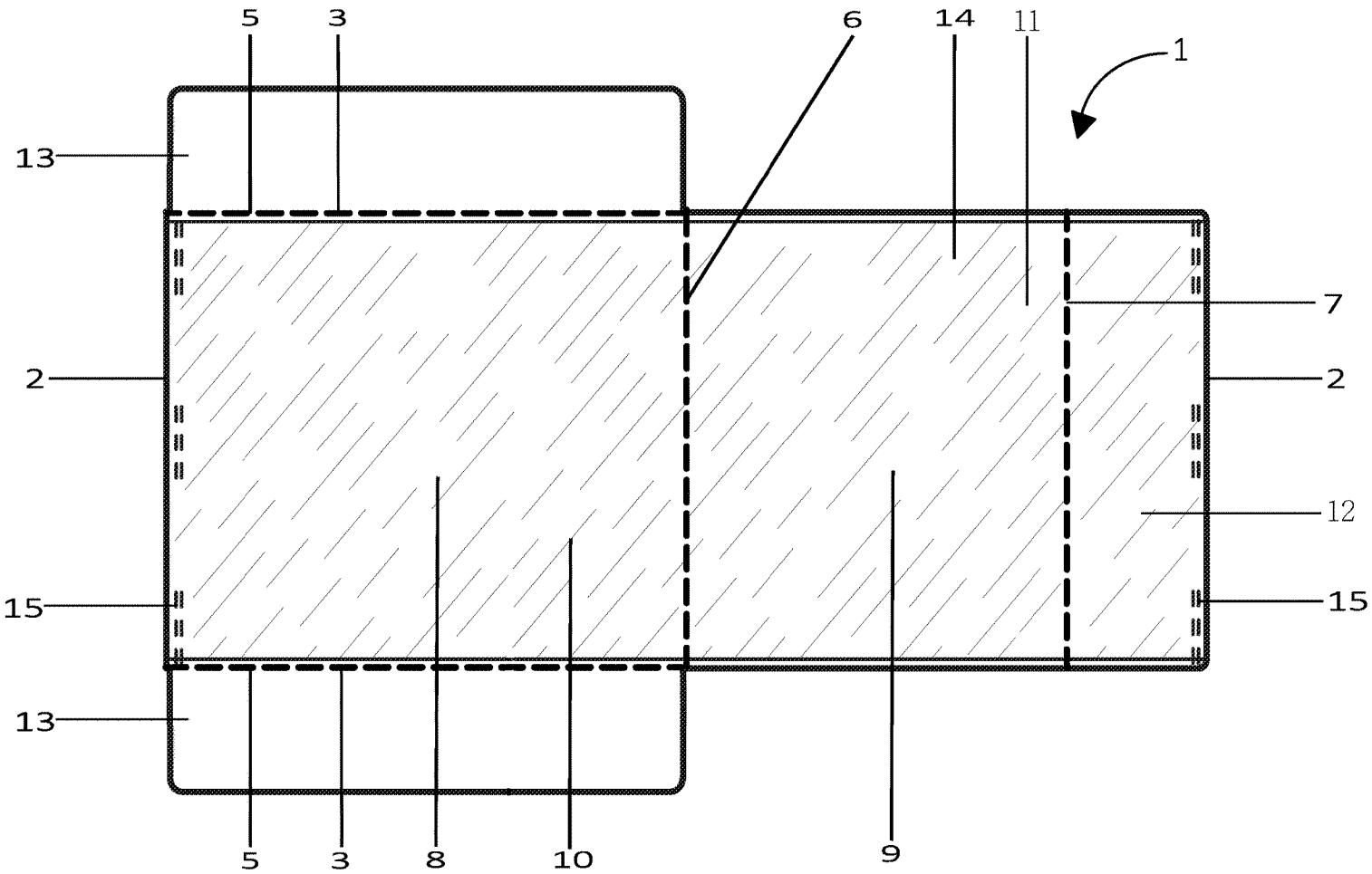
FIG. 1 depicts a first surface of a plan view of an embodiment of the packaging assembly disclosed herein in an unfolded condition.

The term "rigid panel" refers to a panel which is formed of any substantially rigid material and is substantially rectangular in shape. In certain embodiments, the substantially rigid material can hold a load of at least about 0.5 kg, at least about 1 kg, at least about 2 kg, at least about 3 kg, at least about 4 kg, at least about 6 kg, at least about 8 kg or at least about 10 kg per 400 $cm^2$ of the substantially rigid material.

The term "film material" refers to a generally flexible material that is connected to the rigid panel in the corresponding short edges to secure an object against the rigid panel and prevent uncontrolled movement of the object to be packaged.

The term "object" includes any consumer goods that are generally categorized as merchandise and/or other item of common daily use, and/or industrial goods that are generally categorized as equipment, machinery, materials and/or other goods or component parts for use and/or consumption by other industries and/or firms.

The term "substantially rectangular shape" includes rectangular shapes with rounded or sloped corners. In some embodiments, the term "substantially rectangular shape" includes openings anywhere and cutouts along the edges of the rectangular shape. In further embodiments, the term "substantially rectangular shape" includes any irregular shapes that has a substantial portion of its outer edges touching the boundaries of a rectangle.

The term "edge" of the rigid panel disclosed herein refers to a line or border at which a surface on the rigid panel terminates. The line or border can be curved, straight or substantially straight.

The term "long edges" of the rigid panel disclosed herein refer to a longer pair of edges of the rigid panel as seen by an observer when the rigid panel lies flat on a surface. In some embodiments, the long edges are substantially perpendicular to the first fold line or the second fold line.

The term "short edges" of the rigid panel disclosed herein refer to a shorter pair of edges of the rigid panel as seen by an observer when the rigid panel lies flat on a surface. In some embodiments, the short edges are substantially parallel to the first fold line or the second fold line.

The term "base" refers to a portion on the rigid panel that is defined by a pair of long edges, a pair of short edges and a first fold line. In some embodiments, the base is in the center of the rigid panel. In certain embodiments, the base is around the center of the rigid panel. In certain embodiments, the base is near the center of the rigid panel.

The term "long edges of the base" disclosed herein refer to a portion of the pair of long edges of the rigid panel between the first fold line and the short edge which define the base.

The term "folding flap" refers to a portion on the rigid panel that is defined by a pair of long edges, a short edge, and a second fold line. In some embodiments, the folding flap is connected to either the right side or the left side of the rigid panel as seen by an observer when the rigid panel lies flat on a surface. In certain embodiments, the rigid panel consists of one folding flap.

The term "middle portion" refers to a portion on the rigid panel that is defined by a pair of long edges, a first fold line, and a second fold line. In some embodiments, the middle portion is in the center of the rigid panel. In certain embodiments, the middle portion is around the center of the rigid panel. In some embodiments, the middle portion is near the center of the rigid panel. In certain embodiments, the rigid panel consists of one middle portion. In some embodiments, the width of the middle portion is greater than the width of the folding flap by at least 20%, at least 40%, at least 60, at least 80%, at least 100%, at least 200%, at least 400% or at least 600%. In certain embodiments, the width of the middle portion is greater than the width of the folding flap by about 20% to about 600%.

The term "width of the middle portion" refers to the longest distance between the first fold line and the third fold line. The distance is measured by the length of a line perpendicularly to the first fold line and extending from the first fold line to the third fold line.

The term "width of the folding flap" refers to the longest distance between the third fold line and the closest short edge. The distance is measured by the length of a line perpendicularly to the third fold line and extending from the third fold line to the short edge.

The term "folding side portion" refers to a portion on the rigid panel that is connected to the opposite long edges of the base. In some embodiments, the folding side portion is connected to either the top side or the bottom side of the base as seen by an observer when the rigid panel lies flat on a surface. In certain embodiments, a pair of folding side portions are each connected to the top side and the bottom side of the base as seen by an observer when the rigid panel lies flat on a surface.

The term "fold line" refers to a line along which the panel may be creased, crimped, embossed, perforated, scored, or otherwise weakened so as to enhance the foldability of the panel.

The term "cut line" refers to a line along which the panel may be penetrated, notched, perforated or otherwise severed. In some embodiments, the penetrated, perforated, notched or severed panel remain unseparated. In certain embodiments, the penetrated, notched, perforated or severed panel is separated into two portions, wherein the two portions are connected to each other by a flexible attachment means such as adhesive tapes, hinges or a combination thereof.

The term "first fold line" refers to a fold line extending from a long edge to the opposed long edge along which the base is connected to the middle portion.

The term "second fold line" refers to a fold line extending from a long edge to the opposed long edge along which the middle portion is connected to the folding flap.

The term "third fold line" refers to a fold line along a long edge extending from a short edge on the base to a point where the third fold line meets the first fold line.

The term "substantially parallel" refers to any two or more lines or portions having a general orientation accepting moderate ranges of deviation from absolute parallel that are commonly acceptable within the meaning of parallel within the container-folding field. In some embodiments, when the lines or portions intersect, the interior angle of intersection is about 0.5°, about 1°, about 1.5°, about 2°, about 2.5°, about 3°, about 5°, about 6°, about 8°, about 9° or about 10°. In certain embodiments, the corresponding angle of intersection is from about 0.5° to about 10°.

The term "substantially transverse" refers to any set of lines or portions having a slight departure from an absolute perpendicular arrangement. In some embodiments, when the two lines or portions intersect, the interior angle of intersection is 85°, 86°, 87°, 88°, 89°, 90°, 91°, 92°, 93°, 94° or 95°. In certain embodiments, the interior angle of intersection is from about 85° to about 95°.

The term "substantially coplanar" refers to any set of segments or portions having a slight departure from lying absolutely on the same plane. In some embodiments, a set of segments or portions are substantially coplanar when the interior angle between the set of segments or portions is 170°, 171°, 172°, 173°, 174°, 175°, 176°, 177°, 178°, 179°, 180°, 181°, 182°, 183°, 184°, 185°, 186°, 187°, 188°, 189° or 190°. In certain embodiments, a set of segments or portions are substantially coplanar when the interior angle between the set of segments or portions is from about 170° to about 190°

The term "substantially 0 degree" refers to 0°, 1°, 2°, 3°, 4° or 5°.

The term "transparent" refers to polymeric material with a transparency value of about 65%, about 70%, about 75%, about 80%, about 85%, about 90%, about 95%, about 99% or about 99.9% as measured in accordance with ASTM D1746.

The term "translucent" refers to polymeric material with a transparency value of about 35%, about 40%, about 45%, about 50%, about 55% or about 60% as measured in accordance with ASTM D1746.

The term "opaque" refers to polymeric material with a transparency value of about 5%, about 10%, about 15%, about 20%, about 25% or about 30% as measured in accordance with ASTM D1746.

The term "sewing" refers to a single loop of thread that is passed through a piece of material. In some embodiments, the thread is made of cotton. In certain embodiments, the thread is made of natural fiber. In some embodiments, the thread is made of animal fiber. In certain embodiments, the thread is made of synthetic fiber. In some embodiments, the thread is made of polyester. In certain embodiments, the thread is made of fusible. In some embodiments, the thread is made of linen. In certain embodiments, the thread is made of metal. In some embodiments, the thread is made of nylon. In certain embodiments, the thread is made of rayon. In some embodiments, the thread is made of silk. In certain embodiments, the thread is made of wool. In some embodiments, the thread cannot be made of water-soluble. Of course, it will be understood that a number of materials are suitable for the thread and can be selected, or custom designed, by those familiar with such materials without undue experimentation.

The term "unfolded condition" refers to the condition which the base, the folding flap and the middle portion are substantially coplanar. In some embodiments, the unfolded condition refers to the condition which the base, the folding flap, the middle portion and the pair of folding side portions are substantially coplanar. Of course, it will be understood that the unfolded condition of the rigid panel is in a state which the rigid panel is ready to accept an object to be secured.

The term "folded condition" refers to the condition which the folding flap and the middle portion are folded away from the film material and are substantially parallel to the base. In some embodiments, the folded condition refers to the condition which the folding flap and the middle portion are folded away from the film material and are substantially parallel to the base, and the pair of folding side portions are folded towards the film material and are substantially transverse to the base. Of course, it will be understood that the folded condition of the rigid panel is a state which the rigid panel has secured an object to be packaged.

The term "copolymer" refers to a polymer derived from two or more types of monomers, including terpolymers.

The term "unsecured edge portion" refers to the space between the film material and the rigid panel whereby the film material and the rigid panel are not sealed, attached, connected and/or secured to each other by any physical, chemical, and/or mechanical means.

Provided herein are packaging assemblies that can successfully secure objects against a substantially rigid panel and prevent uncontrolled movement of the objects when the rigid panel and the objects are packaged within a box. In some embodiments, the packaging assemblies can be easily operated and fitted into a box by a single assembler. It will be understood that many of the features of the embodiments discussed below may be used in combination with the features of the other various embodiments.

In one aspect, provided herein is a packaging assembly comprising:

a) a substantially rigid panel;

b) a film material; and c) a pair of mating releasable fastener members, wherein the rigid panel comprises a pair of long edges, a pair of short edges, a base, a folding flap, a middle portion between the base and the folding flap, a first fold line between the middle portion and the base, and a second fold line between the middle portion and the folding flap, wherein the film material superimposed on a first surface of the rigid panel comprises a pair of opposite ends, wherein the pair of opposite ends are connected to the rigid panel adjacent to the opposite short edges, and wherein one of the pair of mating releasable fastener members is attached to a second surface of the rigid panel opposite to the first surface, and adjacent to the opposite short edges.

In some embodiments, the first fold line and the second fold line are substantially transverse to the pair of long edges, the pair of long edges, the first fold line and the second fold line define the middle portion, the pair of long edges, one of the short edges and the first fold line define the base, and the pair of long edges, one of the short edges and the second fold line define the folding flap.

In certain embodiments, the rigid panel further comprises a pair of folding side portions, wherein the pair of folding side portions are connected to the opposite long edges of the base, wherein a pair of third fold lines are between the pair of folding side portions and the base.

In some embodiments, the mating releasable fastener members comprise one or more pairs of mating releasable fastener members.

In certain embodiments, the mating releasable fastener members comprise hook-and-loop fasteners, mating magnetic fasteners, self-mating pressure sensitive adhesive fasteners, or a combination thereof.

In some embodiments, the mating releasable fastener members are hook-and-loop fasteners.

In certain embodiments, the first fold line between the middle portion and the base is a cut line and the middle portion and the base remain attached to each other.

In some embodiments, the pair of opposite ends of the film material are connected to the rigid panel by sewing, adhering, gluing, heat welding, ultrasonic welding, stapling, tacking, fastening, clipping, anchoring, retaining and/or securing.

In certain embodiments, the packaging assembly further comprising at least an opening each in the base and in the middle portion respectively and adjacent to a long edge.

In some embodiments, the packaging assembly further comprising at least a cutout each in the base and in the middle portion respectively and along a long edge.

In certain embodiments, the rigid panel has an unfolded condition in which the base, the folding flap and the middle portion are substantially coplanar and has a folded condition in which the folding flap and the middle portion are folded away from the film material and are substantially parallel to the base.

In some embodiments, the rigid panel has an unfolded condition in which the base, the folding flap, the middle portion and the pair of folding side portions are substantially coplanar and has a folded condition in which the folding flap and the middle portion are folded away from the film material and are substantially parallel to the base, and the pair of folding side portions are folded towards the film material and are substantially transverse to the base.

In certain embodiments, the packaging assembly further comprising a box adapted to receive the rigid panel in the folded condition, the box having interior dimensions corresponding to the peripheral dimensions of the rigid panel when folded so that the rigid panel is securely held within the box.

The rigid panel disclosed herein can be in any shape and size suitable to be used for securing objects. In some embodiments, the rigid panel is substantially rectangular in shape. The rigid panel disclosed herein is formed of any substantially rigid material.

In some embodiments, the substantially rigid material is a corrugated cardboard. In certain embodiments, the corrugated cardboard is an A-Flute, B-Flute, C-Flute, E-Flute or F-Flute corrugated cardboard. In some embodiments, the substantially rigid material is a paperboard or a laminate. In other embodiments, the substantially rigid material is a plastic. In certain embodiments, the substantially rigid material is not a corrugated cardboard, a paperboard, a laminate or a plastic. In certain embodiments, the rigid panel is substantially continuous. In some embodiments, the rigid panel comprises one or more openings or cutouts on its surface or along its edges.

In certain embodiments, the rigid panel has an average thickness of at most about 0.75 mm, at most about 1.50 mm, at most about 3.00 mm, at most about 4.50 mm, at most about 6.00 mm, at most about 7.50 mm, at most about 10.00 mm or at most about 12.50 mm. In some embodiments, the rigid panel has an average thickness of at least about 0.075 mm, at least about 0.15 mm, at least about 0.30 mm, at least about 0.45 mm, at least about 0.60 mm, at least about 0.75 mm, at least about 1.00 mm or at least about 1.25 mm.

In certain embodiments, the first fold line, the second fold line and the pair of third fold lines are scored, crimped or perforated.

The film material disclosed herein includes generally a thin continuous polymeric material, which can be transparent, translucent, opaque or colored. In certain embodiments, the film material comprises any material that is suitable for packaging known to a person of ordinary skill in the art. Non-limiting examples of suitable materials include one or more fabrics, such as wovens, knits, nonwovens, openwork meshes, spandex, including Lycra® brand spandex and elastic fabrics. In some embodiments, the film material has a thickness of at most about 0.2 mm, at most about 0.15 mm, at most about 0.13 mm, at most about 0.10 mm, at most about 0.08 mm, at most about 0.05 mm, at most about 0.04 mm, or at most about 0.03 mm. In certain embodiments, the film material has a thickness of at least about 0.03 mm, at least about 0.04 mm, at least about 0.05 mm, or at least about 0.08 mm.

The film material disclosed herein is generally an elastic polymeric material. In some embodiments, the film material has an elastic recovery in the transverse direction and/or longitudinal direction of at least about 60%, at least about 65%, at least about 70%, at least about 75%, at least about 80%, at least about 85%, at least about 90%, at least about 95% or at least about 100% measured according to ASTM D5459 at 100% strain, 30 seconds relaxation time, and 60 second recovery time. In certain embodiments, the film material has a Young's modulus of at least about 13,700 KPa, at least about 17,200 KPa, at least about 20,600 KPa, at least about 24,100 KPa, or at least about 27,500 KPa and/or at most about 55,100 KPa, at most about 68,900 KPa, at most about 103,400 KPa, at most about 137,800 KPa, or at most about 275,700 KPa as measured in accordance with ASTM D882 at a temperature of 73° F. In certain embodiments, the film material has an ultimate elongation value of at least about 100%, at least about 200%, at least about 300%, at least about 400%, or at least about 500%, as measured in accordance with ASTM D412. In certain embodiments, the film material has a low speed puncture maximum load of about 17 newton, about 20 newton, about 22 newton, about 24 newton, about 26 newton, about 28 newton or about 31 newton, measured according to ASTM F1306 using a crosshead speed of 127 mm per minute.

The elastic polymeric material can be an elastomer or a thermoplastic. In certain embodiments, the elastic polymeric material disclosed herein can comprise at least one additive for the purposes of improving and/or controlling the processibility, appearance, physical, chemical, and/or mechanical properties of the elastic polymeric material. Non-limiting examples of suitable additives include colorants or pigments, UV stabilizers, plasticizers, antioxidants, fillers, lubricants, antifogging agents, flow aids, coupling agents, cross-linking agents, nucleating agents, surfactants, slip agents, anti-blocking agents, solvents, flame retardants, antistatic agents, and combinations thereof. The total amount of the additives can range from about greater than 0 to about 80 wt. %, from about 0.001 wt. % to about 70 wt. %, from about 0.01 wt. % to about 60 wt. %, from about 0.1 wt. % to about 50 wt. %, from about 1 wt. % to about 40 wt. %, or from about 10 wt. % to about 50 wt. % of the total weight of the elastic polymeric material. Some polymer additives have been described in Zweifel Hans et al., "*Plastics Additives Handbook*," Hanser Gardner Publications, Cincinnati, Ohio, 5th edition (2001), which is incorporated herein by reference in its entirety.

In some embodiments, the elastic polymeric material is an elastomer. In certain embodiments, the elastomer includes natural or synthetic rubber (e.g., styrene-butadiene rubber, polybutadiene, neoprene rubber, polyisoprene rubber, ethylene-propylene diene monomer (EPDM) rubber, polysiloxane, nitrile rubber, and butyl rubber), and polyurethanes (e.g., polyether polyurethanes, polyester polyurethane, polycarbonate polyurethanes, and thermoplastic polyurethane elastomers). In some embodiments, the polymeric material is thermoplastic polyolefin elastomers (TPOs), which are two-component elastomer systems comprising an elastomer (such as EPDM) finely dispersed in a thermoplastic polyolefin (such as polypropylene or polyethylene).

In certain embodiments, the elastic polymeric material is a thermoplastic polyurethane elastomer. In certain embodiments, the thermoplastic polyurethane elastomer is ELASTOLLAN®, commercially available from the BASF company, Florham Park, USA.

In some embodiments, the elastic polymeric material is a thermoplastic modified with one or more additives for improving and/or controlling elasticity and/or appearance of the thermoplastic for the film material disclosed herein. In some embodiments, the thermoplastic includes polyolefins, polyethylene homopolymers (e.g., low density polyethylene), polyethylene copolymers (e.g., ethylene/alpha-olefin copolymers ("EAOs"), ethylene/unsaturated ester copolymers, and ethylene/(meth)acrylic acid), polypropylene homopolymers, polypropylene copolymers, and polyvinyl chloride.

In some embodiments, the elastic polymeric material disclosed herein can comprise a plasticizer or tackifier. In general, a plasticizer is a chemical that can increase the flexibility and lower the glass transition temperature of polymers. Any plasticizer disclosed herein can used for the elastic polymeric material. Non-limiting examples of plasticizers include mineral oils, abietates, adipates, alkyl sulfonates, azelates, benzoates, chlorinated paraffins, citrates, epoxides, glycol ethers and their esters, glutarates, hydrocarbon oils, isobutyrates, oleates, pentaerythritol derivatives, phosphates, phthalates, esters, polybutenes, ricinoleates, sebacates, sulfonamides, tri- and pyromellitates, biphenyl derivatives, stearates, difuran diesters, fluorine-containing plasticizers, hydroxybenzoic acid esters, isocyanate adducts, multi-ring aromatic compounds, natural product derivatives, nitriles, siloxane-based lamination agents, tar-based products, thioeters and combinations thereof. Where used, the amount of the plasticizer in the elastic polymeric material can be from greater than 0 to about 15 wt. %, from about 0.5 wt. % to about 10 wt. %, or from about 1 wt. % to about 5 wt. % of the total weight of the elastic polymeric material. Some plasticizers have been described in George Wypych, "*Handbook of Plasticizers*," ChemTec Publishing, Toronto-Scarborough, Ontario (2004), which is incorporated herein by reference.

In certain embodiments, the elastic polymeric material disclosed herein can comprise a tackifier. In general, a tackifier is a chemical that can increase the tack and lower the glass transition temperature of polymers. Any tackifier disclosed herein can used for the elastic polymeric material. Non-limiting examples of tackifiers include rosins and their derivatives, terpenes and modified terpenes, aliphatic, cycloaliphatic and aromatic resins (e.g., C5 aliphatic resins, C9 aromatic resins, and C5/C9 aliphatic/aromatic resins), hydrogenated hydrocarbon resins, and their mixtures, and terpene-phenol resins. Where used, the amount of the tackifier in the elastic polymeric material can be from greater than 0 to about 15 wt. %, from about 0.5 wt. % to about 10 wt. %, or from about 1 wt. % to about 5 wt. % of the total weight of the elastic polymeric material.

In some embodiments, the elastic polymeric material disclosed herein optionally comprise a colorant or pigment that can change the look of the elastic polymeric material to human eyes. Any colorant or pigment known to a person of ordinary skill in the art may be added to the elastic polymeric material disclosed herein. Non-limiting examples of suitable colorants or pigments include inorganic pigments such as metal oxides such as iron oxide, zinc oxide, and titanium dioxide, mixed metal oxides, carbon black, organic pigments such as anthraquinones, anthanthrones, azo and monoazo compounds, arylamides, benzimidazolones, BONA lakes, diketopyrrolo-pyrroles, dioxazines, disazo compounds, diarylide compounds, flavanthrones, indanthrones, isoindolinones, isoindolines, metal complexes, monoazo salts, naphthols, b-naphthols, naphthol AS, naphthol lakes, perylenes, perinones, phthalocyanines, pyranthrones, quinacridones, and quinophthalones, and combinations thereof. Where used, the amount of the colorant or pigment in the elastic polymeric material can be from about greater than 0 to about 10 wt. %, from about 0.1 wt. % to about 5 wt. %, or from about 0.25 wt. % to about 2 wt. % of the total weight of the elastic polymeric material. Some colorants have been described in Zweifel Hans et al., "*Plastics Additives Handbook*," Hanser Gardner Publications, Cincinnati, Ohio, 5th edition, Chapter 15, pages 813-882 (2001), which is incorporated herein by reference.

In certain embodiments, the elastic polymeric material disclosed herein optionally comprise an UV stabilizer that may prevent or reduce the degradation of the elastic polymeric material by UV radiations. Any UV stabilizer known to a person of ordinary skill in the art may be added to the elastic polymeric material disclosed herein. Non-limiting examples of suitable UV stabilizers include benzophenones, benzotriazoles, aryl esters, oxanilides, acrylic esters, formamidines, carbon black, hindered amines, nickel quenchers, hindered amines, phenolic antioxidants, metallic salts, zinc compounds and combinations thereof. Where used, the amount of the UV stabilizer in the elastic polymeric material can be from about greater than 0 to about 5 wt. %, from about 0.01 to about 3 wt. %, from about 0.1 wt. % to about 2 wt. %, or from about 0.1 wt. % to about 1 wt. % of the total weight of the elastic polymeric material. Some UV stabilizers have been described in Zweifel Hans et al., "*Plastics Additives Handbook*," Hanser Gardner Publications, Cincinnati, Ohio, 5th edition, Chapter 2, pages 141-426 (2001), which is incorporated herein by reference.

In certain embodiments, the elastic polymeric material disclosed herein can comprise a lubricant. In general, the lubricant can be used, inter alia, to modify the rheology of the molten elastic polymeric material, to improve the surface finish of molded articles, and/or to facilitate the dispersion of fillers or pigments. Any lubricant known to a person of ordinary skill in the art may be added to the elastic polymeric material disclosed herein. Non-limiting examples of suitable lubricants include fatty alcohols and their dicarboxylic acid esters, fatty acid esters of short-chain alcohols, fatty acids, fatty acid amides, metal soaps, oligomeric fatty acid esters, fatty acid esters of long-chain alcohols, montan waxes, polyethylene waxes, polypropylene waxes, natural and synthetic paraffin waxes, fluoropolymers and combinations thereof. Where used, the amount of the lubricant in the elastic polymeric material can be from about greater than 0 to about 5 wt. %, from about 0.1 wt. % to about 4 wt. %, or from about 0.1 wt. % to about 3 wt. % of the total weight of the elastic polymeric material. Some suitable lubricants have been disclosed in Zweifel Hans et al., "*Plastics Additives Handbook*," Hanser Gardner Publications, Cincinnati, Ohio, 5th edition, Chapter 5, pages 511-552 (2001), both of which are incorporated herein by reference.

Optionally, the elastic polymeric material disclosed herein can comprise an antistatic agent. Generally, the antistatic agent can increase the conductivity of the elastic polymeric material and to prevent static charge accumulation. Any antistatic agent known to a person of ordinary skill in the art may be added to the elastic polymeric material disclosed herein. Non-limiting examples of suitable antistatic agents include conductive fillers (e.g., carbon black, metal particles and other conductive particles), fatty acid esters (e.g., glycerol monostearate), ethoxylated alkylamines, diethanolamides, ethoxylated alcohols, alkylsulfonates, alkylphosphates, quaternary ammonium salts, alkylbetaines and combinations thereof. Where used, the amount of the antistatic agent in the elastic polymeric material can be from about greater than 0 to about 5 wt. %, from about 0.01 wt. % to about 3 wt. %, or from about 0.1 wt. % to about 2 wt. % of the total weight of the elastic polymeric material. Some suitable antistatic agents have been disclosed in Zweifel Hans et al., "*Plastics Additives Handbook*," Hanser Gardner Publications, Cincinnati, Ohio, 5th edition, Chapter 10, pages 627-646 (2001), both of which are incorporated herein by reference.

In some embodiments, the elastic polymeric material disclosed herein comprise a slip agent. In other embodiments, the elastic polymeric material disclosed herein do not comprise a slip agent. Slip is the sliding of film surfaces over each other or over some other substrates. The slip performance of films can be measured by ASTM D 1894, *Static and Kinetic Coefficients of Friction of Plastic Film and Sheeting*, which is incorporated herein by reference. In general, the slip agent can convey slip properties by modifying the surface properties of films; and reducing the friction between layers of the films and between the films and other surfaces with which they come into contact.

Any slip agent known to a person of ordinary skill in the art may be added to the elastic polymeric material disclosed herein. Non-limiting examples of the slip agents include primary amides having about 12 to about 40 carbon atoms (e.g., erucamide, oleamide, stearamide and behenamide); secondary amides having about 18 to about 80 carbon atoms (e.g., stearyl erucamide, behenyl erucamide, methyl erucamide and ethyl erucamide); secondary-bis-amides having about 18 to about 80 carbon atoms (e.g., ethylene-bis-stearamide and ethylene-bis-oleamide); and combinations thereof.

In certain embodiments, the slip agent is a primary amide with a saturated aliphatic group having between 18 and about 40 carbon atoms (e.g., stearamide and behenamide). In other embodiments, the slip agent is a primary amide with an unsaturated aliphatic group containing at least one carbon-carbon double bond and between 18 and about 40 carbon atoms (e.g., erucamide and oleamide). In further embodiments, the slip agent is a primary amide having at least 20 carbon atoms. In further embodiments, the slip agent is erucamide, oleamide, stearamide, behenamide, ethylene-bis-stearamide, ethylene-bis-oleamide, stearyl erucamide, behenyl erucamide or a combination thereof. In a particular embodiment, the slip agent is erucamide. In further embodiments, the slip agent is commercially available having a trade name such as ATMER™ SA from Uniqema, Everberg, Belgium; ARIVIOSLIP® from Akzo Nobel Polymer Chemicals, Chicago, Ill.; KEMAMIDE® from Witco, Greenwich, Conn.; and CRODAMIDE® from Croda, Edison, N.J. Where used, the amount of the slip agent in the elastic polymeric material can be from about greater than 0 to about 3 wt. %, from about 0.0001 wt. % to about 2 wt. %, from about 0.001 wt. % to about 1 wt. %, from about 0.001 wt. % to about 0.5 wt. % or from about 0.05 wt. % to about 0.25 wt. % of the total weight of the elastic polymeric material. Some slip agents have been described in Zweifel Hans et al., "*Plastics Additives Handbook*," Hanser Gardner Publications, Cincinnati, Ohio, 5th edition, Chapter 8, pages 601-608 (2001), which is incorporated herein by reference.

In some embodiments, the elastic polymeric material disclosed herein can comprise an anti-blocking agent. In some embodiments, the elastic polymeric material disclosed herein do not comprise an anti-blocking agent. The anti-blocking agent can be used to prevent the undesirable adhesion between touching layers of articles made from the elastic polymeric material, particularly under moderate pressure and heat during storage, manufacture or use. Any anti-blocking agent known to a person of ordinary skill in the art may be added to the elastic polymeric material disclosed herein. Non-limiting examples of anti-blocking agents include minerals (e.g., clays, chalk, and calcium carbonate), synthetic silica gel (e.g., SYLOBLOC® from Grace Davison, Columbia, Md.), natural silica (e.g., SUPER FLOSS® from Celite Corporation, Santa Barbara, Calif.), talc (e.g., OPTIBLOC® from Luzenac, Centennial, Colo.), zeolites (e.g., SIPERNAT® from Degussa, Parsippany, N.J.), aluminosilicates (e.g., SILTON® from Mizusawa Industrial Chemicals, Tokyo, Japan), limestone (e.g., CARBOREX® from Omya, Atlanta, Ga.), spherical polymeric particles (e.g., EPOSTAR®, poly(methyl methacrylate) particles from Nippon Shokubai, Tokyo, Japan and TOSPEARL®, silicone particles from GE Silicones, Wilton, Conn.), waxes, amides (e.g. erucamide, oleamide, stearamide, behenamide, ethylene-bis-stearamide, ethylene-bis-oleamide, stearyl erucamide and other slip agents), molecular sieves, and combinations thereof. The mineral particles can lower blocking by creating a physical gap between articles, while the organic anti-blocking agents can migrate to the surface to limit surface adhesion. Where used, the amount of the anti-blocking agent in the elastic polymeric material can be from about greater than 0 to about 3 wt. %, from about 0.0001 wt. % to about 2 wt. %, from about 0.001 wt. % to about 1 wt. %, or from about 0.001 wt. % to about 0.5 wt. % of the total weight of the elastic polymeric material. Some anti-blocking agents have been described in Zweifel Hans et al., "*Plastics Additives Handbook*," Hanser Gardner Publications, Cincinnati, Ohio, 5th edition, Chapter 7, pages 585-600 (2001), which is incorporated herein by reference.

The packaging assembly disclosed herein includes means for securing the film material to the opposite short edges, which is of mechanical or chemical nature. In some embodiments, the means includes sewing, adhering, gluing, heat welding, ultrasonic welding, stapling, tacking, fastening, clipping, anchoring, retaining and/or securing. In certain embodiments, the means cannot constitute of glue strips or glue dots. The secured portions of the film material define two unsecured edge portions of the film substantially adjacent to the long edges through which an object to be packaged is inserted between the film material and the base.

In certain embodiments, the secured portions of the film material cooperate with the folding flap to tighten the film material against an object between the film material and the base when the folding flap is folded away from the film material and towards the second surface of the rigid panel. The middle portion is folded away from the film material and towards the second surface of the rigid panel until the angle between the connecting middle portion and base are substantially 0 degree, and the folding flap is folded towards the film material and away from the second surface of the rigid panel. A hand is then inserted through one of the unsecured edge portions of the film material to loosen the film material relative to the base. The object to be secured is then inserted more easily through one of the unsecured edge portions. To secure the object, the folding flap is folded away from the film material and towards the second surface of the rigid panel until the folding flap is secured on the second surface of the rigid panel by the mating releasable fastener members, in which the film material is tightened against at least a portion of the object. When the rigid panel is in its folded condition, the film material must extend over a slightly greater distance than it would when the rigid panel is in its unfolded condition, i.e., when the base, the folding flap and the middle portion are substantially coplanar. It will be easily understood that the strain on the film material in turn increases the film material's tension and grip on the object to be secured.

In some embodiments, the folded rigid panel is then inserted into a box having inner dimensions corresponding to the peripheral dimensions of the folded rigid panel. Thus, when placed in the box, the folding side portions are restrained from unfolding by the inner sides of the box. Thus, the object, when placed in the box, is maintained out of direct contact with the box in all three axes, which can further reduce the risk of physical impact damage.

In some embodiments, the rigid panel disclosed herein comprises at least an opening each in the base and in the middle portion adjacent to a long edge and at least a cutout each in the base and in the middle portion along the opposite long edge. In certain embodiments, the opening is to accommodate a part for fixing an object to a particular position on the base. In some embodiments, when the rigid panel is folded and placed in a box as discussed above, materials such as instruction manuals are inserted through the cutout and are packaged together with the object. Of course, it will be understood that a number of materials can be inserted through the cutout and can be packaged together with an object. It will also be understood that the size or shape of the cutout can be custom made to accommodate the size or shape of the material to be packaged together with an object.

In an exemplary embodiment, the packaging assembly disclosed herein is easier to operate comparing to a prior art packaging assembly which generally comprises a pair of folding side flaps and a pair of folding end flaps around a center portion of a rigid panel. An object is inserted between a flexible film material and the center portion and is secured when the folding side flaps are folded away from the flexible film material to tighten the flexible film material against the object. The folding end flaps are then folded in the same or opposite direction to the folding side flaps. The rigid panel in its folded condition is then placed in a box having interior dimensions which correspond to the peripheral dimensions of the folded rigid panel. The major problem with the typical packaging assembly is that it is difficult to keep the typical packaging assembly in the folded condition by one assembler. This is because while the pair of folding side flaps are folded in order to tighten the flexible film material against an object, the tension created on the flexible film material causes the pair of folding side flaps to rebound to an unfolded condition. Accordingly, the flexible film material would remain relaxed over the object unless the assembler continuously holds onto the pair of folding side flaps with both hands. With both hands being occupied, the assembler could not fold the pair of folding end flaps without the assistance of an additional assembler. Without fixing both pairs of folding side flaps and folding end flaps to their respective folded positions, the rigid panel could not be smoothly fitted into a box having interior dimensions which correspond to the peripheral dimensions of the folded rigid panel. The typical packaging assembly would require more cost, time and labor to secure an object to be packaged as compared to the exemplary packaging assembly.

In another aspect, provided herein is a method for packaging an object in the packaging assembly disclosed herein, wherein the method comprises the steps of:

a) folding the middle portion away from the film material and towards the second surface of the rigid panel;

b) folding the folding flap towards the film material and away from the second surface of the rigid panel;

c) inserting at least a portion of the object into the packaging assembly through an opening defined by an unsecured edge portion of the film material and the rigid panel on the first surface of the rigid panel;

d) folding the folding flap away from the film material and towards the second surface of the rigid panel until the folding flap is secured on the second surface of the rigid panel by the mating releasable fastener members, in which the film material is tightened against at least a portion of the object; and e) placing the folded panel with the object into a box having interior dimensions corresponding to the peripheral dimensions of the folded panel.

In another aspect, provided herein is a method for packaging an object in the packaging assembly disclosed herein, wherein the method comprises the steps of:

a) folding the middle portion towards the film material;

b) inserting at least a portion of the object into the packaging assembly through an opening defined by an unsecured edge portion of the film material and the rigid panel on the first surface of the rigid panel;

c) folding the middle portion and the folding flap away from the film material and towards the second surface of the rigid panel until the middle portion is substantially parallel to the base and the folding flap is secured on the second surface of the rigid panel by the mating releasable fastener members, in which the film material is tightened against at least a portion of the object; and d) placing the folded panel with the object into a box having interior dimensions corresponding to the peripheral dimensions of the folded panel.

In another aspect, provided herein is a method for packaging an object in the packaging assembly disclosed herein, wherein the method comprises the steps of:

a) folding the middle portion away from the film material and towards the second surface of the rigid panel;

b) folding the folding flap towards the film material and away from the second surface of the rigid panel;

c) inserting at least a portion of the object into the packaging assembly through an opening defined by an unsecured edge portion of the film material and the rigid panel on the first surface of the rigid panel;

d) folding the folding flap away from the film material and towards the second surface of the rigid panel until the folding flap is secured on the second surface of the rigid panel by the mating releasable fastener members, in which the film material is tightened against at least a portion of the object and the pair of folding side portions are folded towards the film material and are substantially transverse to the base; and e) placing the folded panel with the object into a box having interior dimensions corresponding to the peripheral dimensions of the folded panel.

In another aspect, provided herein is a method for packaging an object in the packaging assembly disclosed herein, wherein the method comprises the steps of:

a) folding the middle portion towards the film material;

b) inserting at least a portion of the object into the packaging assembly through an opening defined by an unsecured edge portion of the film material and the rigid panel on the first surface of the rigid panel;

c) folding the middle portion and the folding flap away from the film material and towards the second surface of the rigid panel until the middle portion is substantially parallel to the base and the folding flap is secured on the second surface of the rigid panel by the mating releasable fastener members, in which the film material is tightened against at least a portion of the object and the pair of folding side portions are folded towards the film material and are substantially transverse to the base; and d) placing the folded panel with the object into a box having interior dimensions corresponding to the peripheral dimensions of the folded panel.

FIG. 1 depicts a first surface (14) of a plan view of an embodiment of the packaging assembly (1) disclosed herein in an unfolded condition comprising a rigid panel (11), a film material (10), a folding flap (12), a pair of long edges (3), a pair of short edges (2), a base (8) around the center of the rigid panel (11), a middle portion (9) between the base (8) and the folding flap (12); a pair of folding side portions (13), each connected to the opposite long edges (3) of the base (8), wherein a pair of third fold lines (5) are between the pair of folding side portions (13) and the base (8); a first fold line (6) between the middle portion (9) and the base (8); and a second fold line (7) between the middle portion (9) and the folding flap (12), wherein the first fold line (6) and the second fold line (7) are substantially transverse to the pair of long edges (3), wherein the pair of long edges (3), the first fold line (6) and the second fold line (7) define the middle portion (9), wherein the pair of long edges (3), one of the short edges (2) and the first fold line (6) define the base (8), wherein the pair of long edges (3), one of the short edges (2) and the second fold line (7) define the folding flap (12), and wherein the film material (10) superimposed on the first surface (14) of the rigid panel (11) comprises a pair of opposite ends, wherein the pair of opposite ends are connected to the rigid panel (11) adjacent to the opposite short edges (2) by sewing, adhering, gluing, heat welding, ultrasonic welding, stapling, tacking, fastening, clipping, anchoring, retaining and/or securing (15).

Figure 2:
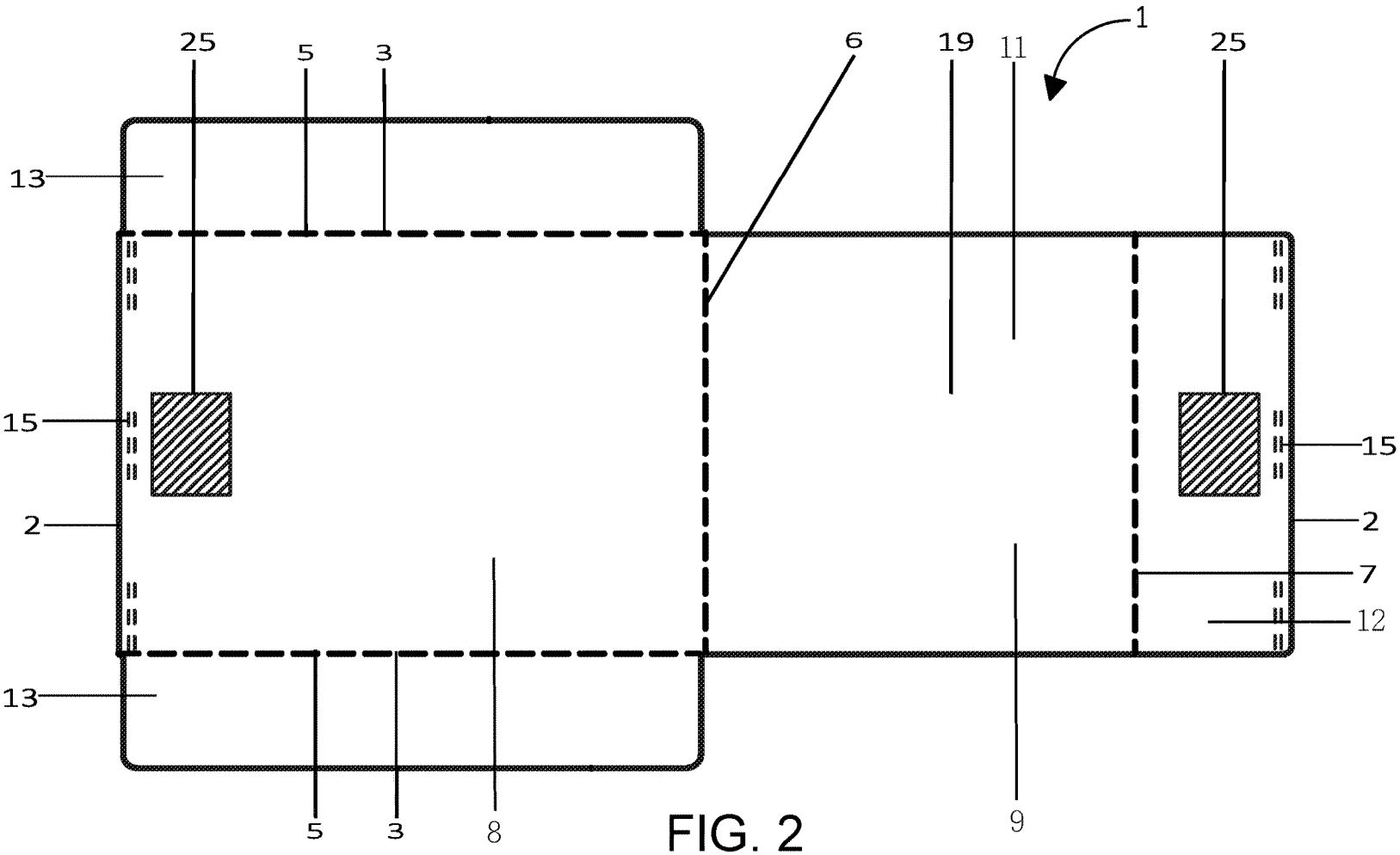
FIG. 2 depicts a second surface of a plan view of the embodiment of the packaging assembly as shown in FIG. 1 in an unfolded condition.

FIG. 2 depicts a second surface (19) of a plan view of the embodiment of the packaging assembly (1) as shown in FIG. 1 in an unfolded condition comprising a rigid panel (11), a folding flap (12), a pair of long edges (3), a pair of short edges (2), a base (8) around the center of the rigid panel (11), a middle portion (9) between the base (8) and the folding flap (12); a pair of folding side portions (13), each connected to the opposite long edges (3) of the base (8), wherein a pair of third fold lines (5) are between the pair of folding side portions (13) and the base (8); a first fold line (6) between the middle portion (9) and the base (8); a second fold line (7) between the middle portion (9) and the folding flap (12); and mating releasable fastener members (25) attached to the second surface (19) of the rigid panel (11) opposite to the first surface (14) adjacent to opposite short edges (2), wherein the first fold line (6) and the second fold line (7) are substantially transverse to the pair of long edges (3), wherein the pair of long edges (3), the first fold line (6) and the second fold line (7) define the middle portion (9), wherein the pair of long edges (3), one of the short edges (2) and the first fold line (6) define the base (8), wherein the pair of long edges (3), one of the short edges (2) and the second fold line (7) define the folding flap (12), and wherein the film material (10) superimposed on the first surface (14) of the rigid panel (11) comprises a pair of opposite ends, wherein the pair of opposite ends are connected to the rigid panel (11) adjacent to the opposite short edges (2) by sewing, adhering, gluing, heat welding, ultrasonic welding, stapling, tacking, fastening, clipping, anchoring, retaining and/or securing (15).

Figure 3:
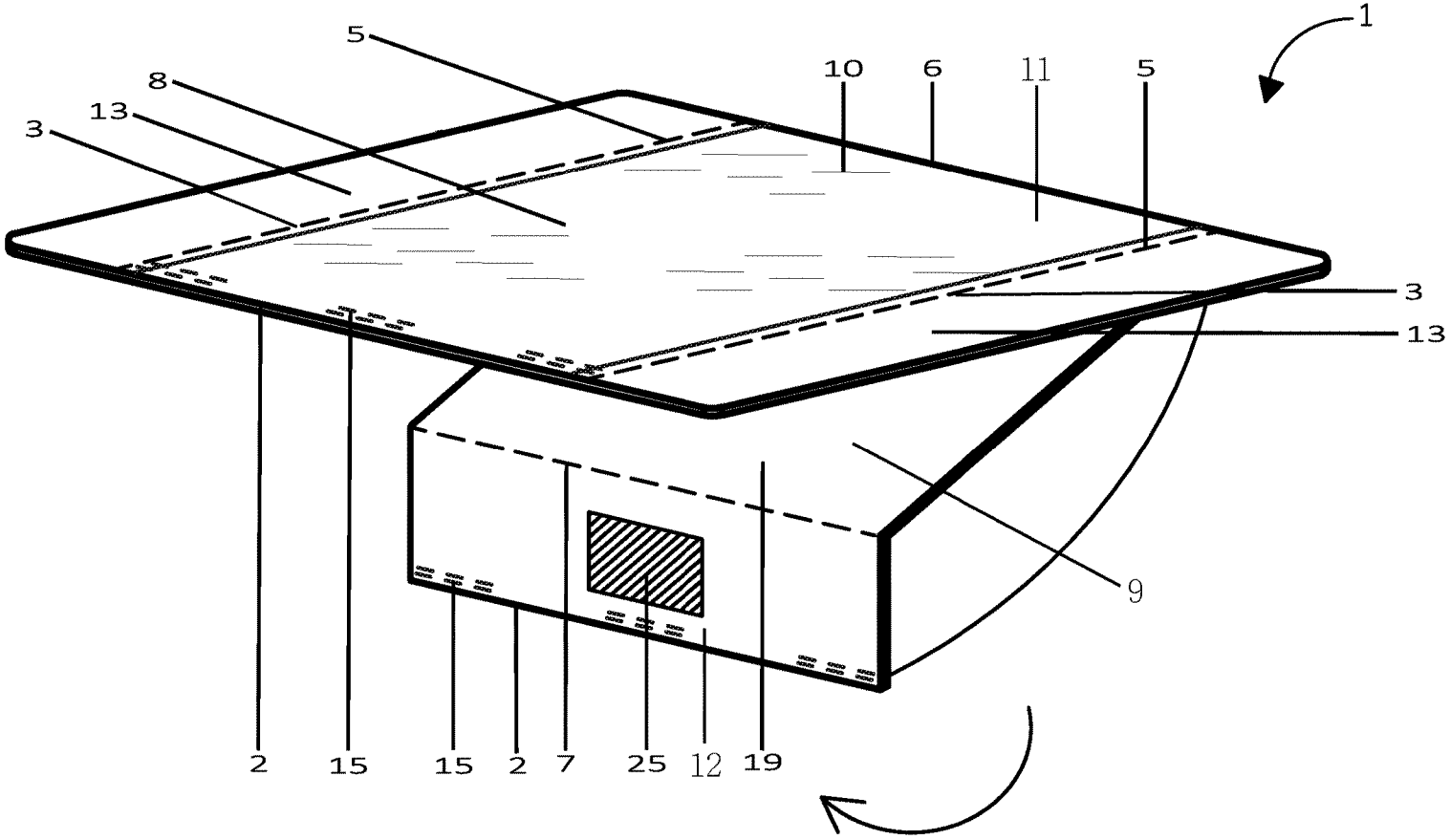
FIG. 3 depicts a perspective view of the embodiment of the packaging assembly as shown in FIG. 1 to illustrate the direction in which the middle portion is folded.

FIG. 3 depicts a perspective view of the embodiment of the packaging assembly (1) as shown in FIG. 1 to illustrate the direction in which the middle portion (9) is folded; the embodiment comprises a rigid panel (11), a folding flap (12), a pair of long edges (3), a pair of short edges (2), a base (8) around the center of the rigid panel (11), a middle portion (9) between the base (8) and the folding flap (12); a pair of folding side portions (13), each connected to the opposite long edges (3) of the base (8), wherein a pair of third fold lines (5) are between the pair of folding side portions (13) and the base (8); a first fold line (6) between the middle portion (9) and the base (8); a second fold line (7) between the middle portion (9) and the folding flap (12); and mating releasable fastener members (25) attached to the second surface (19) of the rigid panel (11) opposite to the first surface (14) adjacent to opposite short edges (2), wherein the first fold line (6) and the second fold line (7) are substantially transverse to the pair of long edges (3), wherein the pair of long edges (3), the first fold line (6) and the second fold line (7) define the middle portion (9), wherein the pair of long edges (3), one of the short edges (2) and the first fold line (6) define the base (8), wherein the pair of long edges (3), one of the short edges (2) and the second fold line (7) define the folding flap (12), wherein the film material (10) superimposed on the first surface (14) of the rigid panel (11) comprises a pair of opposite ends, wherein the pair of opposite ends are connected to the rigid panel (11) adjacent to the opposite short edges (2) by sewing, adhering, gluing, heat welding, ultrasonic welding, stapling, tacking, fastening, clipping, anchoring, retaining and/or securing (15), and wherein middle portion (9) is folded away from the film material (10) and towards the second surface (19) of the rigid panel (11) until the angle between the connecting middle portion (9) and base (8) are substantially 0 degree.

Figure 4:
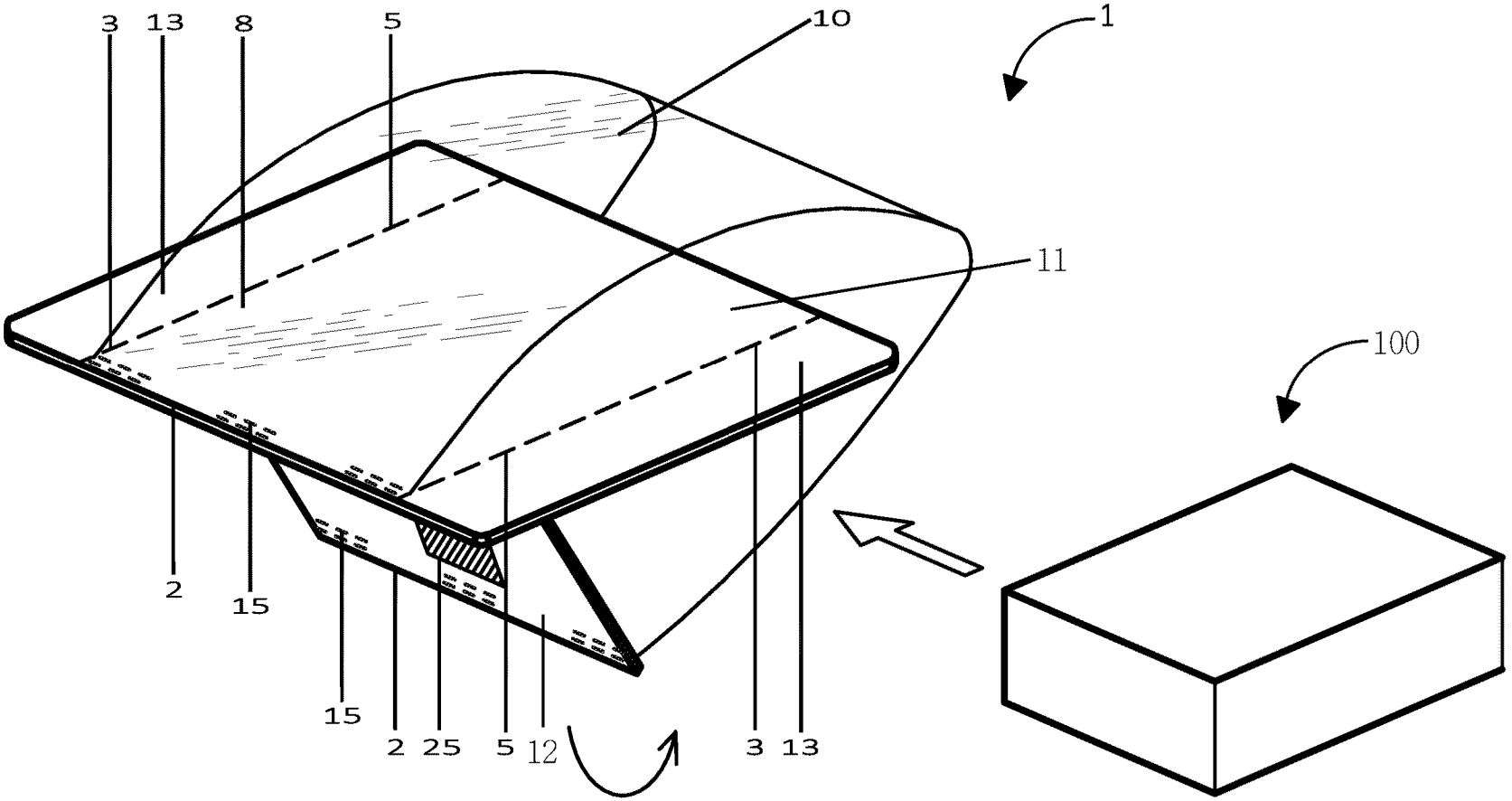
FIG. 4 depicts a perspective view of the embodiment of the packaging assembly as shown in FIG. 1 to illustrate the insertion of an object.

FIG. 4 depicts a perspective view of the embodiment of the packaging assembly (1) as shown in FIG. 1 to illustrate the insertion of an object; the embodiment comprises a rigid panel (11), a folding flap (12), a pair of long edges (3), a pair of short edges (2), a base (8) around the center of the rigid panel (11), a middle portion (9) between the base (8) and the folding flap (12); a pair of folding side portions (13), each connected to the opposite long edges (3) of the base (8), wherein a pair of third fold lines (5) are between the pair of folding side portions (13) and the base (8); and mating releasable fastener members (25) attached to the second surface (19) of the rigid panel (11) opposite to the first surface (14) adjacent to opposite short edges (2), wherein the film material (10) superimposed on the first surface (14) of the rigid panel (11) comprises a pair of opposite ends, wherein the pair of opposite ends are connected to the rigid panel (11) adjacent to the opposite short edges (2) by sewing, adhering, gluing, heat welding, ultrasonic welding, stapling, tacking, fastening, clipping, anchoring, retaining and/or securing (15), wherein the folding flap (12) is folded towards the film material (10) and away from the second surface (19) of the rigid panel (11), and wherein an object (100) to be secured is inserted through one of the unsecured edge portions of the rigid panel (11).

Figure 5:
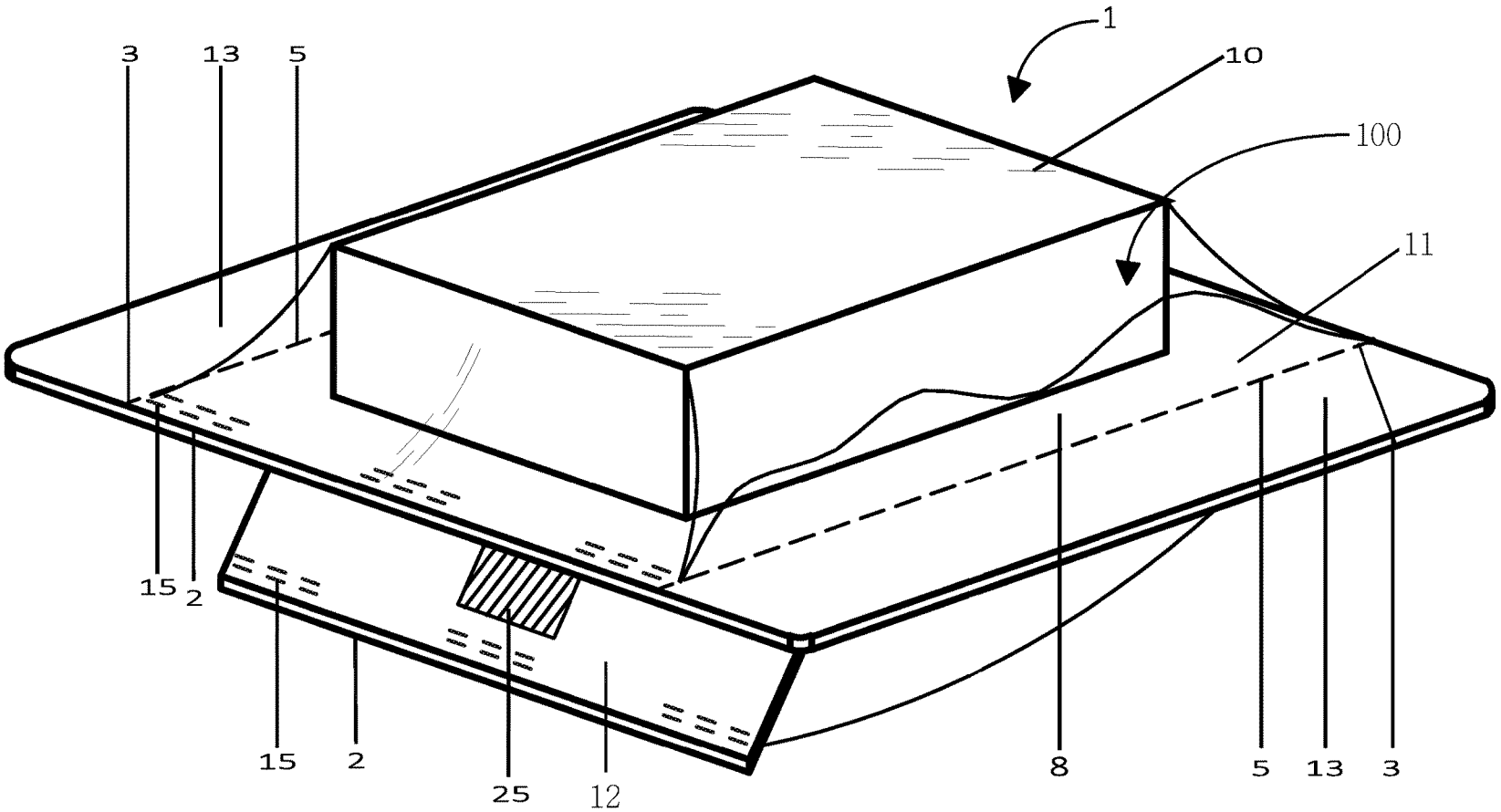
FIG. 5 depicts a perspective view of the embodiment of the packaging assembly as shown in FIG. 1 to illustrate the direction in which the folding flap is folded to secure an object.

FIG. 5 depicts a perspective view of the embodiment of the packaging assembly (1) as shown in FIG. 1 to illustrate the direction in which the folding flap (12) is folded to secure an object (100); the embodiment comprises a rigid panel (11), a folding flap (12), a pair of long edges (3), a pair of short edges (2), a base (8) around the center of the rigid panel (11); a pair of folding side portions (13), each connected to the opposite long edges (3) of the base (8), wherein a pair of third fold lines (5) are between the pair of folding side portions (13) and the base (8); and mating releasable fastener members (25) attached to the second surface (19) of the rigid panel (11) opposite to the first surface (14) adjacent to opposite short edges (2), wherein the film material (10) superimposed on the first surface (14) of the rigid panel (11) comprises a pair of opposite ends, wherein the pair of opposite ends are connected to the rigid panel (11) adjacent to the opposite short edges (2) by sewing, adhering, gluing, heat welding, ultrasonic welding, stapling, tacking, fastening, clipping, anchoring, retaining and/or securing (15), and wherein the folding flap (12) is folded away from the film material (10) and towards the second surface (19) of the rigid panel (11) until the folding flap (12) is secured on the second surface (19) of the rigid panel (11) by the mating releasable fastener members (25), in which the film material (10) is tightened against at least a portion of the object (100).

Figure 6:
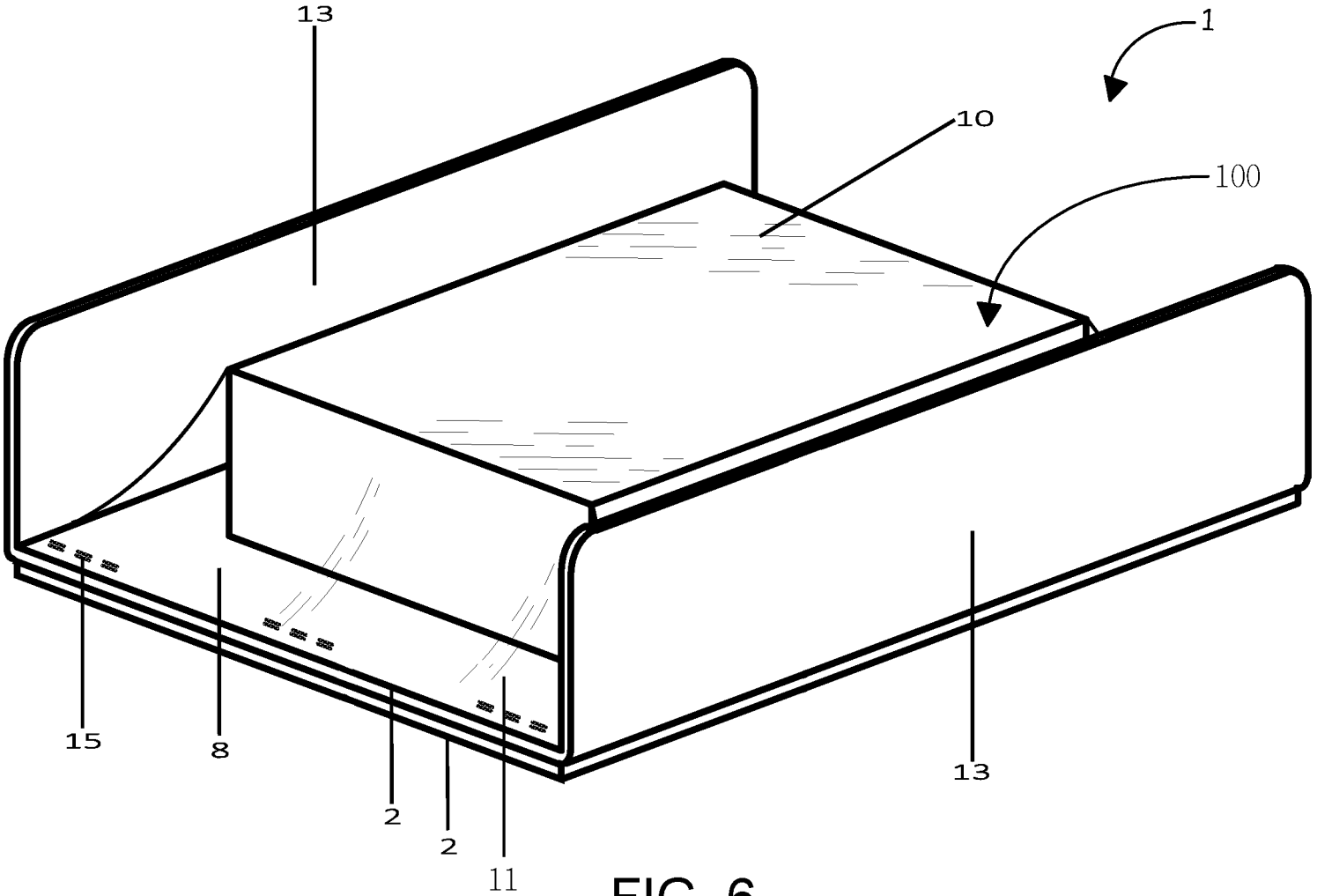
FIG. 6 depicts a perspective view of the embodiment of the packaging assembly as shown in FIG. 1 in a folded condition.

FIG. 6 depicts a perspective view of the embodiment of the packaging assembly (1) as shown in FIG. 1 in a folded condition comprising a rigid panel (11), a film material (10), a pair of short edges (2), a base (8) around the center of the rigid panel (11); a pair of folding side portions (13), each connected to the opposite long edges (3) of the base (8), wherein the film material (10) superimposed on the first surface (14) of the rigid panel (11) comprises a pair of opposite ends, wherein the pair of opposite ends are connected to the rigid panel (11) adjacent to the opposite short edges (2) by sewing, adhering, gluing, heat welding, ultrasonic welding, stapling, tacking, fastening, clipping, anchoring, retaining and/or securing (15), and an object (100) being secured in between the base (8) and the film material (10), wherein the pair of folding side portions (13) are substantially transverse to the base (8). When the rigid panel (11) is in the folded condition, the film material (10) must extend over a slightly greater distance than it would when the rigid panel (11) is in the unfolded condition, i.e., when the base (8), the folding flap (12) and the middle portion (9) are substantially coplanar. It will be easily understood that the strain on the film material (10) in turn increases the film material's (10) tension and grip on the object (100) to be secured.

Figure 7:
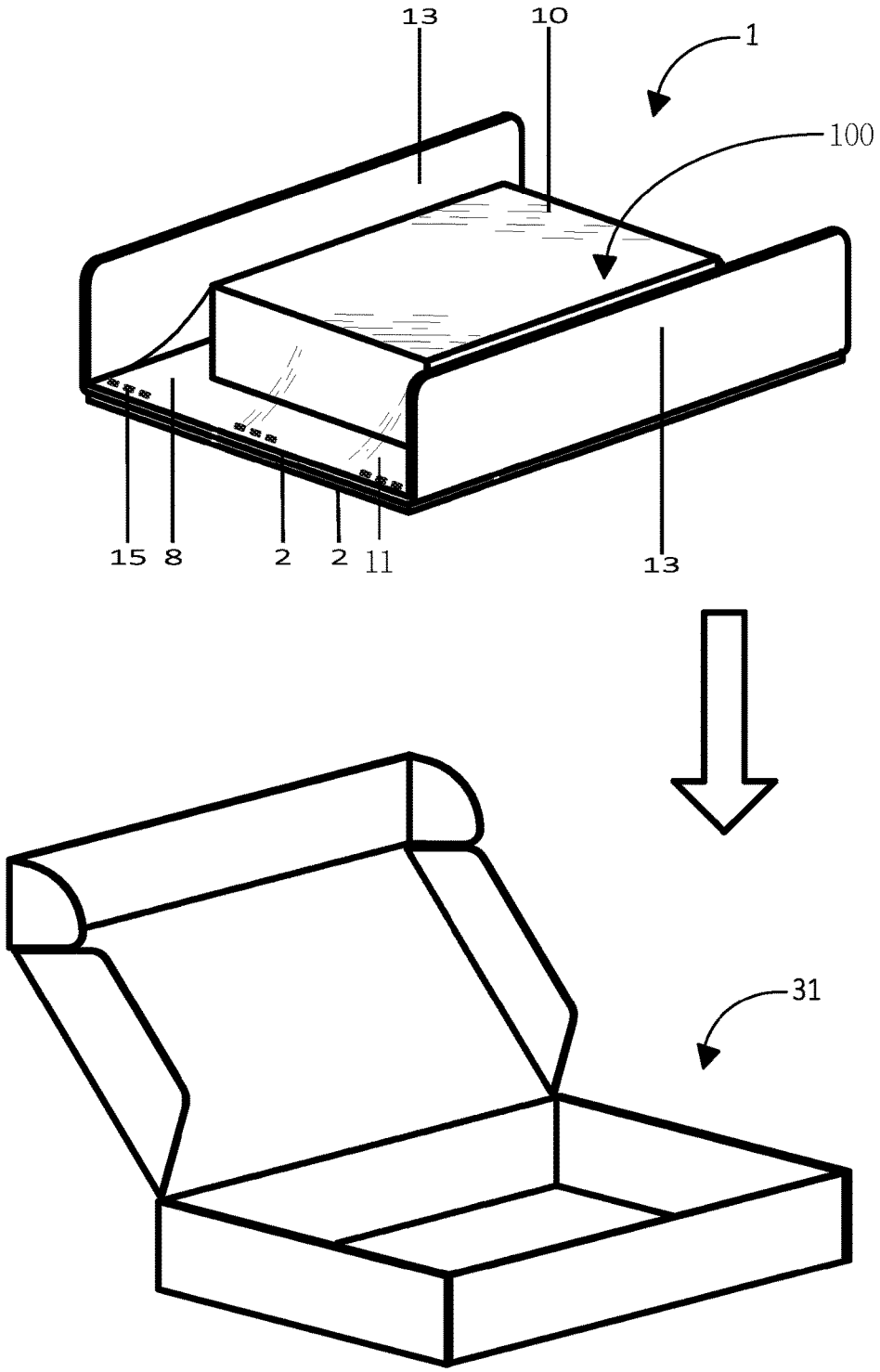
FIG. 7 depicts a perspective view of the embodiment of the packaging assembly as shown in FIG. 1 illustrating the way in which the packaging assembly fits inside a box.

FIG. 7 depicts a perspective view of the embodiment of the packaging assembly (1) as shown in FIG. 1 illustrating the way in which the packaging assembly (1) fits inside a box (31); the embodiment comprises a rigid panel (11), a film material (10), a pair of short edges (2), a base (8) around the center of the rigid panel (11); a pair of folding side portions (13), each connected to the opposite long edges (3) of the base (8), wherein the film material (10) superimposed on the first surface (14) of the rigid panel (11) comprises a pair of opposite ends, wherein the pair of opposite ends are connected to the rigid panel (11) adjacent to the opposite short edges (2) by sewing, adhering, gluing, heat welding, ultrasonic welding, stapling, tacking, fastening, clipping, anchoring, retaining and/or securing (15), and an object (100) being secured in between the base (8) and the film material (10), wherein the pair of folding side portions (13) are substantially transverse to the base (8); and a box (31), wherein the rigid panel (11) in the folded condition is inserted into the box (31) having inner dimensions corresponding to the peripheral dimensions of the folded rigid panel (11). Thus, when placed in the box (31), the folding side portions (13) are restrained from unfolding by the inner sides of the box (31). In addition, the folding flap (12) is also restrained from unfolding by the inner bottom of the box (31). Thus, the object (100), when placed in the box (31), is maintained out of direct contact with the box (31) in all three axes, which can further reduce the risk of physical impact damage.

Figure 8:
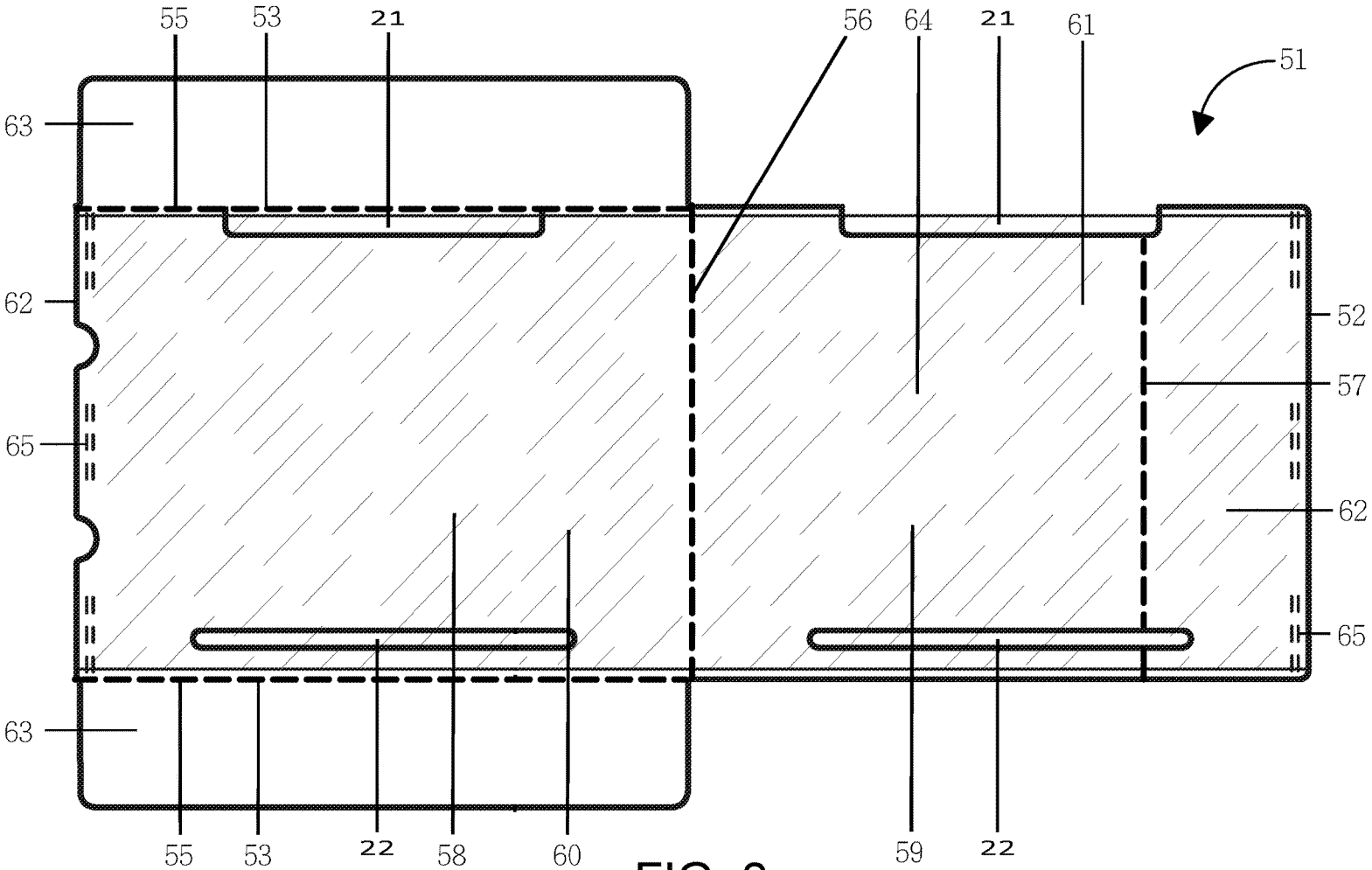
FIG. 8 depicts a first surface of a plan view of another embodiment of the packaging assembly disclosed herein in an unfolded condition.

FIG. 8 depicts a first surface (64) of a plan view of another embodiment of the packaging assembly (51) disclosed herein in an unfolded condition comprising a rigid panel (61), a film material (60), a folding flap (62), a pair of long edges (53), a pair of short edges (52), a base (58) around the center of the rigid panel (61), a middle portion (59) between the base (58) and the folding flap (62); a pair of folding side portions (63), each connected to the opposite long edges (53) of the base (58), wherein a pair of third fold lines (55) are between the pair of folding side portions (63) and the base (58); a first fold line (56) between the middle portion (59) and the base (58); and a second fold line (57) between the middle portion (59) and the folding flap (62), wherein the first fold line (56) and the second fold line (57) are substantially transverse to the pair of long edges (53), wherein the pair of long edges (53), the first fold line (56) and the second fold line (57) define the middle portion (59), wherein the pair of long edges (53), one of the short edges (52) and the first fold line (56) define the base (58), wherein the pair of long edges (53), one of the short edges (52) and the second fold line (57) define the folding flap (62), and wherein the film material (60) superimposed on the first surface (64) of the rigid panel (61) comprises a pair of opposite ends, wherein the pair of opposite ends are connected to the rigid panel (61) adjacent to the opposite short edges (52) by sewing, adhering, gluing, heat welding, ultrasonic welding, stapling, tacking, fastening, clipping, anchoring, retaining and/or securing (65); an opening (22) each in the base (58) and in the middle portion (59) adjacent to a long edge (53); and a cutout (21) each in the base (58) and in the middle portion (59) along the opposite long edge (53).

Figure 9:
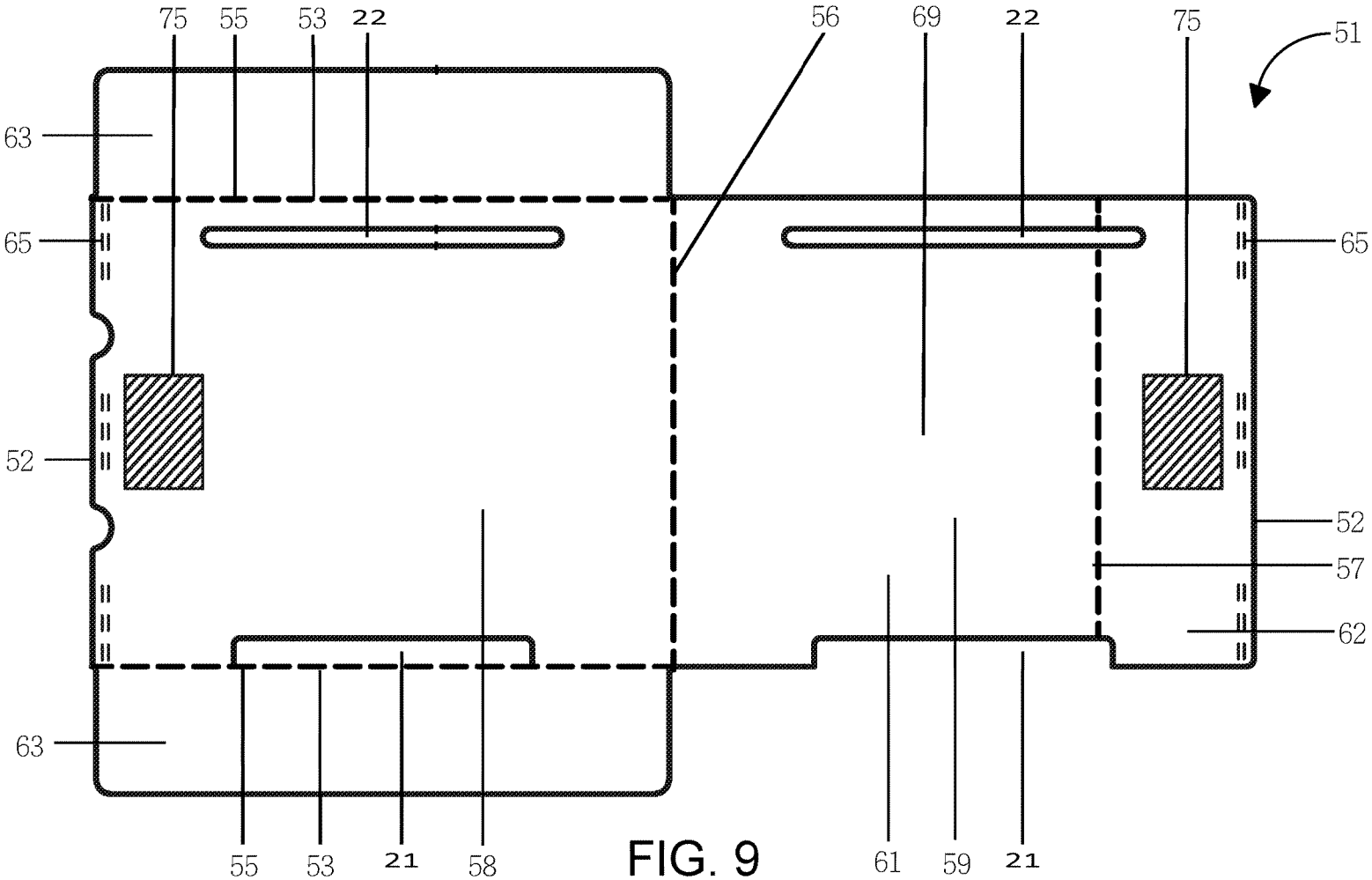
FIG. 9 depicts a second surface of a plan view of the embodiment of the packaging assembly as shown in FIG. 8 in an unfolded condition.

FIG. 9 depicts a second surface (69) of a plan view of the embodiment of the packaging assembly (51) as shown in FIG. 8 in an unfolded condition comprising a rigid panel (61), a folding flap (62), a pair of long edges (53), a pair of short edges (52), a base (58) around the center of the rigid panel (61), a middle portion (59) between the base (58) and the folding flap (62); a pair of folding side portions (63), each connected to the opposite long edges (53) of the base (58), wherein a pair of third fold lines (55) are between the pair of folding side portions (63) and the base (58); a first fold line (56) between the middle portion (59) and the base (58); a second fold line (57) between the middle portion (59) and the folding flap (62); and mating releasable fastener members (75) attached to the second surface (69) of the rigid panel (61) opposite to the first surface (64) adjacent to opposite short edges (52), wherein the first fold line (56) and the second fold line (57) are substantially transverse to the pair of long edges (53), wherein the pair of long edges (53), the first fold line (56) and the second fold line (57) define the middle portion (59), wherein the pair of long edges (53), one of the short edges (52) and the first fold line (56) define the base (58), wherein the pair of long edges (53), one of the short edges (52) and the second fold line (57) define the folding flap (62), and wherein the film material (60) superimposed on the first surface (64) of the rigid panel (61) comprises a pair of opposite ends, wherein the pair of opposite ends are connected to the rigid panel (61) adjacent to the opposite short edges (52) by sewing, adhering, gluing, heat welding, ultrasonic welding, stapling, tacking, fastening, clipping, anchoring, retaining and/or securing (65); an opening (22) each in the base (58) and in the middle portion (59) adjacent to a long edge (53); and a cutout (21) each in the base (58) and in the middle portion (59) along the opposite long edge (53).

FIGS. 1-9 depicts just two non-limiting embodiments of the packaging assembly disclosed herein. Variations and modifications from the embodiment exist.

As demonstrated above, embodiments of the invention provide packaging assemblies that can successfully secure objects against a substantially rigid panel and prevent uncontrolled movement of the objects when the rigid panel and the objects are packaged within a box. While the invention has been described with respect to a limited number of embodiments, the specific features on one embodiment should not be attributed to other embodiments of the invention. No single embodiment is representative of all aspects of the invention. Variations and modifications from the described embodiments exist. The appended claims intend to cover all such variations and modifications as falling within the scope of the invention.

All publications and patent applications mentioned in this specification are herein incorporated by reference to the same extent as if each individual publication or patent application was specifically and individually indicated to be incorporated by reference. Although the foregoing invention has been described in some detail by way of illustration and example for purpose of clarity of understanding, it will be readily apparent to those of ordinary skill in the art in light of the teachings of this invention that certain changes and modifications may be made thereto without departing from the spirit or scope of the appended claims.

What is claimed is:

1. A packaging assembly comprising:

a) a substantially rigid panel;

b) a film material; and c) mating releasable fastener members, wherein the rigid panel comprises a pair of long edges, a pair of short edges, a base, a folding flap, a middle portion between the base and the folding flap, a first fold line between the middle portion and the base, and a second fold line between the middle portion and the folding flap, wherein the film material superimposed on a first surface of the rigid panel comprises a pair of opposite ends, wherein the pair of opposite ends are connected to the rigid panel adjacent to the pair of short edges, wherein one of the mating releasable fastener members is attached to a second surface of the rigid panel opposite to the first surface, and adjacent to one of the pair of short edges, wherein the mating releasable fastener members comprise one or more pairs of mating releasable fastener members, and wherein the mating releasable fastener members comprise any or a combination of hook-and-loop fasteners, mating magnetic fasteners, and self-mating pressure sensitive adhesive fasteners.

2. The packaging assembly of claim 1, wherein the first fold line and the second fold line are substantially transverse to the pair of long edges, wherein the pair of long edges, the first fold line and the second fold line define the middle portion, wherein the pair of long edges, a first one of the pair of short edges and the first fold line define the base, and wherein the pair of long edges, a second one of the pair of short edges and the second fold line define the folding flap.

3. The packaging assembly of claim 1, wherein the rigid panel further comprises a pair of folding side portions, wherein each one of the pair of folding side portions is connected to a respective one of the pair of long edges of the base, wherein each one of a pair of third fold lines is between a respective one of the pair of folding side portions and the base.

4. The packaging assembly of claim 3, wherein the rigid panel has an unfolded condition in which the base, the folding flap, the middle portion and the pair of folding side portions are substantially coplanar, and the rigid panel has a folded condition in which the folding flap and the middle portion are folded away from the film material and are substantially parallel to the base, and in which folded condition, the pair of folding side portions are folded towards the film material and are substantially transverse to the base.

5. The packaging assembly of claim 4 further comprising a box adapted to receive the rigid panel in the folded condition, the box having interior dimensions corresponding to peripheral dimensions of the rigid panel when in the folded condition so that the rigid panel is securely held within the box.

6. A method for packaging an object in the packaging assembly of claim 3, wherein the method comprises the steps of:

a) folding the middle portion away from the film material and towards the second surface of the rigid panel;

b) folding the folding flap towards the film material and away from the second surface of the rigid panel;

c) inserting at least a portion of the object into the packaging assembly through an opening defined by an unsecured edge portion of the film material and on the first surface of the rigid panel;

d) folding the folding flap away from the film material and towards the second surface of the rigid panel until the folding flap is secured on the second surface of the rigid panel by the mating releasable fastener members, in which the film material is tightened against at least a portion of the object and the pair of folding side portions are folded towards the film material and are substantially transverse to the base; and e) placing the folded rigid panel with the object into a box having interior dimensions corresponding to peripheral dimensions of the folded rigid panel.

7. A method for packaging an object in the packaging assembly of claim 3, wherein the method comprises the steps of:

a) folding the middle portion towards the film material;

b) inserting at least a portion of the object into the packaging assembly through an opening defined by an unsecured edge portion of the film material and the first surface of the rigid panel;

c) folding the middle portion and the folding flap away from the film material and towards the second surface of the rigid panel until the middle portion is substantially parallel to the base and the folding flap is secured on the second surface of the rigid panel by the mating releasable fastener members, in which the film material is tightened against at least a portion of the object and the pair of folding side portions are folded towards the film material and are substantially transverse to the base; and d) placing the folded rigid panel with the object into a box having interior dimensions corresponding to peripheral dimensions of the folded rigid panel.

8. The packaging assembly of claim 1, wherein the mating releasable fastener members comprise hook-and-loop fasteners.

9. The packaging assembly of claim 1, wherein the first fold line between the middle portion and the base is a cut line and the middle portion and the base remain attached to each other.

10. The packaging assembly of claim 1, wherein each one of the pair of opposite ends of the film material is connected to the rigid panel by at least one of sewing, adhering, gluing, heat welding, ultrasonic welding, stapling, tacking, fastening, clipping, anchoring, retaining and securing.

11. The packaging assembly of claim 1 further comprising an respective opening in each of the base and the middle portion, and each opening is disposed adjacent to one of the pair of long edges.

12. The packaging assembly of claim 1 further comprising a respective cutout in each of the base and the middle portion, and each cutout is disposed along one of the pair of long edges.

13. The packaging assembly of claim 1, wherein the rigid panel has an unfolded condition in which the base, the folding flap and the middle portion are substantially coplanar, and the rigid panel has a folded condition in which the folding flap and the middle portion are folded away from the film material and are substantially parallel to the base.

14. The packaging assembly of claim 13 further comprising a box adapted to receive the rigid panel in the folded condition, the box having interior dimensions corresponding to peripheral dimensions of the rigid panel when in the folded condition so that the rigid panel is securely held within the box.

15. A method for packaging an object in the packaging assembly of claim 1, wherein the method comprises the steps of:

a) folding the middle portion away from the film material and towards the second surface of the rigid panel;

b) folding the folding flap towards the film material and away from the second surface of the rigid panel;

c) inserting at least a portion of the object into the packaging assembly through an opening defined by an unsecured edge portion of the film material and the first surface of the rigid panel;

d) folding the folding flap away from the film material and towards the second surface of the rigid panel until the folding flap is secured on the second surface of the rigid panel by the mating releasable fastener members, in which the film material is tightened against at least a portion of the object; and e) placing the folded rigid panel with the object into a box having interior dimensions corresponding to peripheral dimensions of the folded rigid panel.

16. A method for packaging an object in the packaging assembly of claim 1, wherein the method comprises the steps of:

a) folding the middle portion towards the film material;

b) inserting at least a portion of the object into the packaging assembly through an opening defined by an unsecured edge portion of the film material and the first surface of the rigid panel;

c) folding the middle portion and the folding flap away from the film material and towards the second surface of the rigid panel until the middle portion is substantially parallel to the base and the folding flap is secured on the second surface of the rigid panel by the mating releasable fastener members, in which the film material is tightened against at least a portion of the object; and d) placing the folded rigid panel with the object into a box having interior dimensions corresponding to peripheral dimensions of the folded rigid panel.

17. A packing assembly comprising:

a rigid panel comprising a panel base, a panel flap, and a panel middle segment between the panel base and the panel flap, the panel base having opposite sides comprising an up facing surface and a down facing surface; and a film material connected to the rigid panel, the film material comprising a first portion and a second portion, the first portion movable above the up facing surface of the panel base, the second portion disposed on the panel flap, wherein the rigid panel comprises a first fold line between the panel base and the panel middle segment that allows the panel middle segment to be at a position under the down facing surface of the panel base such that the down facing surface of the panel base faces the panel middle segment, wherein the rigid panel comprises a second fold line that is located under the down facing surface of the panel base, is between the panel middle segment and the panel flap, and allows the panel flap to fold from a first position to a second position in which the film material is tighter on the rigid panel as compared to the first position, and wherein the up facing surface of the panel base faces the first portion of the film material, and the down facing surface of the panel base faces the second fold line.

18. The packing assembly of claim 17, wherein when the panel flap is in the first position, the panel base and the film material form an opening sufficient to allow insertion of an object between the panel base and the film material.

19. The packing assembly of claim 17, further comprising:

a fastener configured to fasten the panel flap to the panel base when the panel flap is in the second position.

* * * * *